US007865980B1

(12) United States Patent
Fuller et al.

(10) Patent No.: US 7,865,980 B1
(45) Date of Patent: Jan. 11, 2011

(54) POTTY TRAINING SYSTEM

(76) Inventors: Meletha R. Fuller, 1203 E. Overton Rd., Dallas, TX (US) 75216; Monica L. Heath, 1014 Rahambeau St., Mount Pleasant, TX (US) 75455

( * ) Notice: Subject to any disclaimer, the term of this patent is extended or adjusted under 35 U.S.C. 154(b) by 1426 days.

(21) Appl. No.: 11/272,268

(22) Filed: Nov. 14, 2005

(51) Int. Cl.
*A47K 11/04* (2006.01)

(52) U.S. Cl. ..... 4/483; 4/902

(58) Field of Classification Search ..... 4/479–483, 4/902

See application file for complete search history.

(56) References Cited

U.S. PATENT DOCUMENTS

| | | | | | |
|---|---|---|---|---|---|
| 3,715,549 | A | | 2/1973 | Kraff | |
| 3,905,051 | A | | 9/1975 | Gozdziewski | |
| 4,199,826 | A | * | 4/1980 | Devereux | 4/479 |
| D302,583 | S | | 8/1989 | Lemmeyer | |
| 5,161,263 | A | * | 11/1992 | Geneve et al. | 4/483 |
| 5,369,820 | A | * | 12/1994 | Blount | 4/483 |
| 5,560,051 | A | | 10/1996 | Butts | |
| 5,685,029 | A | | 11/1997 | Gee | |
| 5,781,939 | A | * | 7/1998 | Bledsoe | 4/483 |
| 5,978,976 | A | | 11/1999 | Chai | |
| 6,081,943 | A | * | 7/2000 | Garcete | 4/483 |
| 6,430,758 | B1 | * | 8/2002 | Cabrera | 4/484 |
| 7,237,278 | B1 | * | 7/2007 | Scott | 4/902 |

* cited by examiner

*Primary Examiner*—Tuan N Nguyen

(57) ABSTRACT

A potty training system includes a base member having a substantially planer bottom surface and including a rubber coated bottom layer to maintain the system at a substantially stationary position during operating conditions. The base member further has a top surface that has an opening wherein a reservoir is removably positionable therein. An upper section connected to the lower section extends upwardly therefrom and has a plurality of slots for storing various objects. The system further includes a mechanism for playing an audio medium. A power source is connected to the playing mechanism and may include a rechargeable battery. The potty training system may further include at least one electronic device for providing audio sounds, a microprocessor connected to the at least one electronic device for controlling the operation thereof based upon an input provided by a user as well as a plurality of speakers connected to the microprocessor.

4 Claims, 6 Drawing Sheets

POTTY TRAINING SYSTEM

CROSS REFERENCE TO RELATED APPLICATIONS

Not Applicable

STATEMENT REGARDING FEDERALLY SPONSORED RESEARCH OR DEPLOYMENT

Not Applicable

REFERENCE TO MICROFICHE APPENDIX

Not Applicable

BACKGROUND OF THE INVENTION

1. Technical Field

This invention relates to a potty training system and, more particularly to a story telling training potty.

2. Prior Art

According to Freudianism, babyhood of one through about twenty four-month old infants is the important stage for basic formation of character, and most of the two through about six-year old infants can relieve themselves in a given place and in the correct body position through several toilet-training and trials and errors. If motivation is provided to children in this babyhood to show their intention to evacuate, they can easily go to stool by themselves. This toilet training helps children with becoming well rounded.

Babyhood is a very important stage of the life of human being because the babyhood is the stage for basic formation of emotion, custom and character. It is preferred to let the infants naturally acquaint themselves with interest with the correct emotion as well as with the correct custom. The conventional potty scarcely lets the infants naturally accustom themselves to relieve themselves in a given place and in the correct body position.

Conventional childhood development includes instruction of the child by the parent or guardian on use of a toilet. This phase of childhood development is commonly referred to a "toilet training" or "potty training" and during this time the child is encouraged to use a toilet rather than rely upon diapers or the like. Instruction on use of a toilet requires patience and perseverance on the part of the parent because children are highly individual on how they react to the training. It is therefore highly desirable to reduce the amount of time it takes to instruct small children on the proper use of a toilet.

In addition, a device that will make urination into the toilet enjoyable and interesting for the child is desirable. It is believed that attracting the child's attention to the toilet will encourage urination and therefore alleviate and/or avoid the stress normally associated during this period.

Accordingly, the need remains for a story telling training potty for improving and promoting the potty training experience for children.

BRIEF SUMMARY OF THE INVENTION

In view of the foregoing background, it is therefore an object of the present invention to provide a system for potty training children of various ages. These and other objects, features, and advantages of the invention are provided by a potty training system including a base member including a lower section that has a plurality of sidewalls integral with each other for forming a generally rectangular shape. The base member may include a plurality of handles connected thereto and extending outwardly from select ones of the plurality of sidewalls. Such a plurality of handles assist a user to transport the system between remote locations.

The system may further include a splash guard, which preferably has a substantially rectangular shape, connected to the base member adjacent to the plurality of speakers so that the speakers can be protected during operation of the system. The base member further has a substantially planer bottom surface, including a bottom layer secured to the bottom surface and is positionable on a ground surface. Such a bottom layer may be formed from rubber material to thereby maintain the system at a substantially stationary position during operating conditions.

The lower section of the base member further has a top surface that has an opening disposed substantially medially between the plurality of sidewalls. The lower section includes a reservoir removably positionable within the opening for receiving human excrements therein. Advantageously, the reservoir may be easily removed and cleaned after use.

The base member further includes an upper section connected to the lower section and extends upwardly therefrom. The upper section has a plurality of slots formed therein for storing various objects and further includes a rear surface. An access panel is connected to the rear surface and allows an operator to selectively access an interior portion of the upper section. There may be a seat pivotally connected to the base member, which is selectively movable between open and closed positions for covering the opening.

The system may further include a mechanism for playing an audio medium. Such a mechanism may be housed within the upper section and disposed rearward of the opening. A power source is also housed within the upper section and is connected to the playing mechanism for supplying power thereto. Such a power source may include a rechargeable battery. The playing mechanism preferably includes at least one electronic device for providing audio sounds, a microprocessor connected to the at least one electronic device for controlling the operation thereof based upon an input provided by a user, and a plurality of speakers connected to the microprocessor. Such speakers are preferably disposed partially exterior of the upper section for channeling sound towards a user seated on the lower section of the base member.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
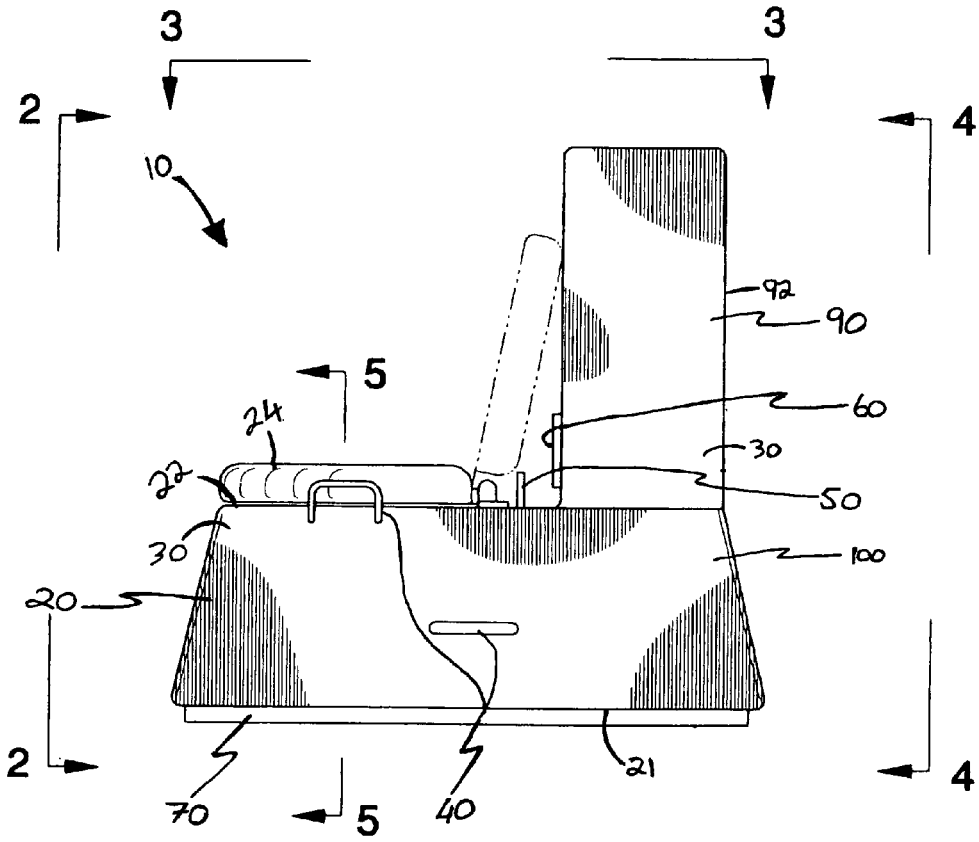
FIG. 1 is a side elevational view showing a potty training system, in accordance with the present invention.
Figure 2:
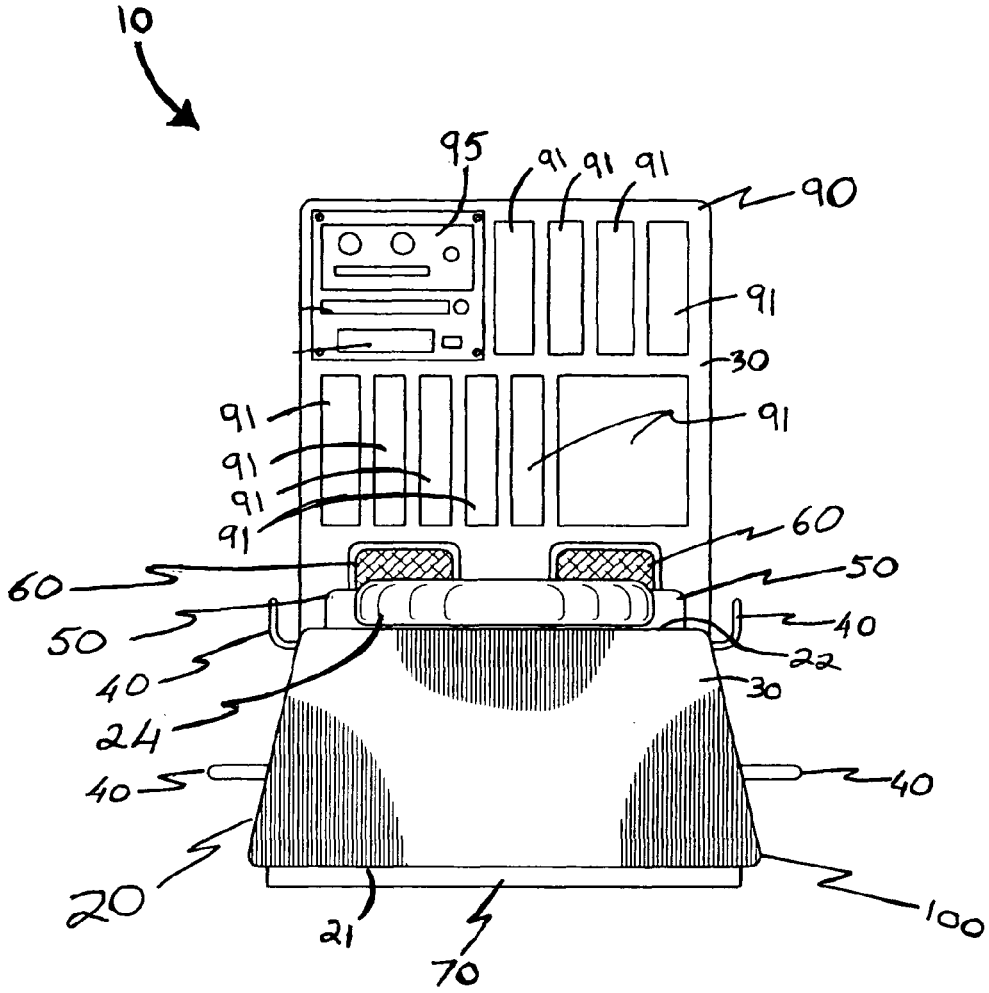
FIG. 2 is a front elevational view of the system shown in FIG. 1, taken along line 2-2.
Figure 3:
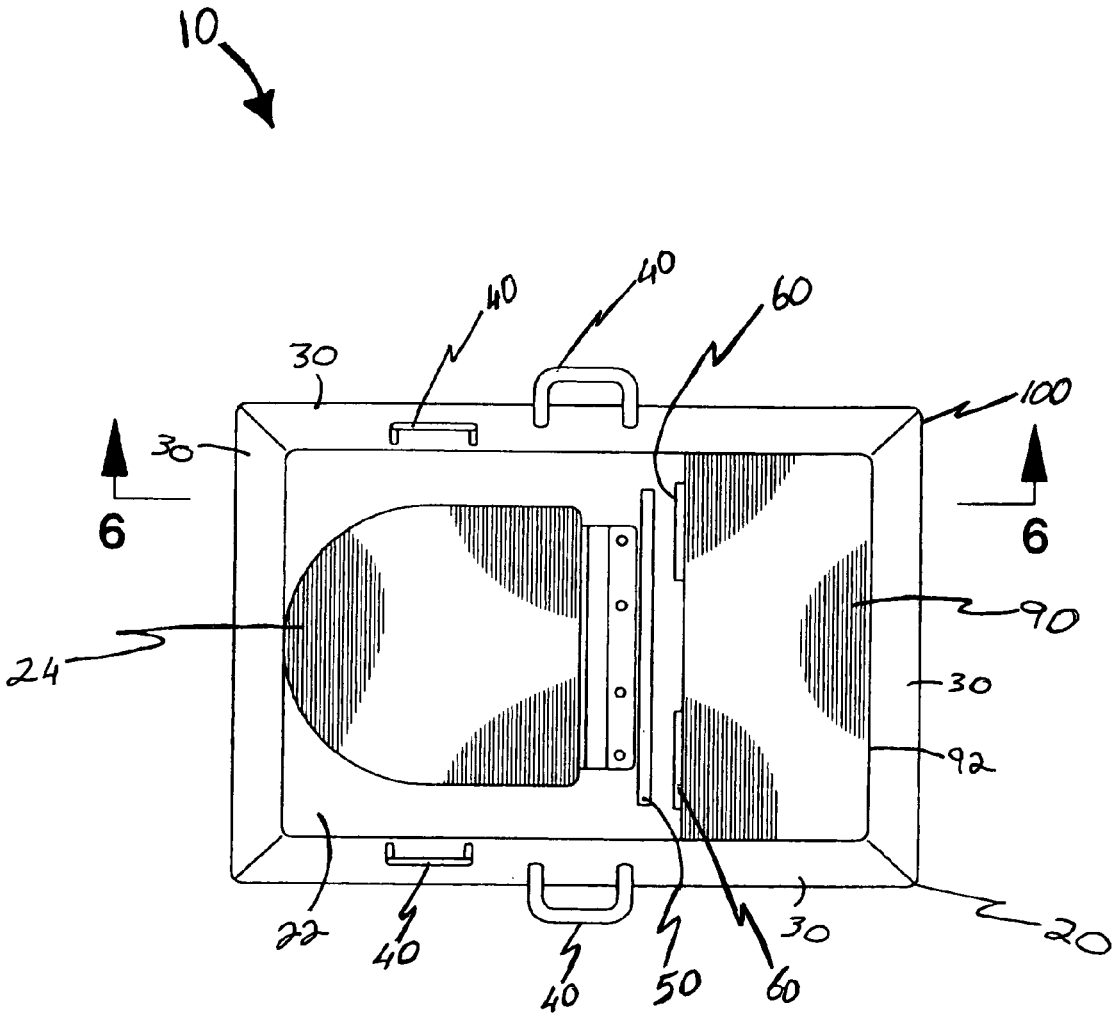
FIG. 3 is a top plan view of the system shown in FIG. 1, taken along line 3-3.
Figure 4:
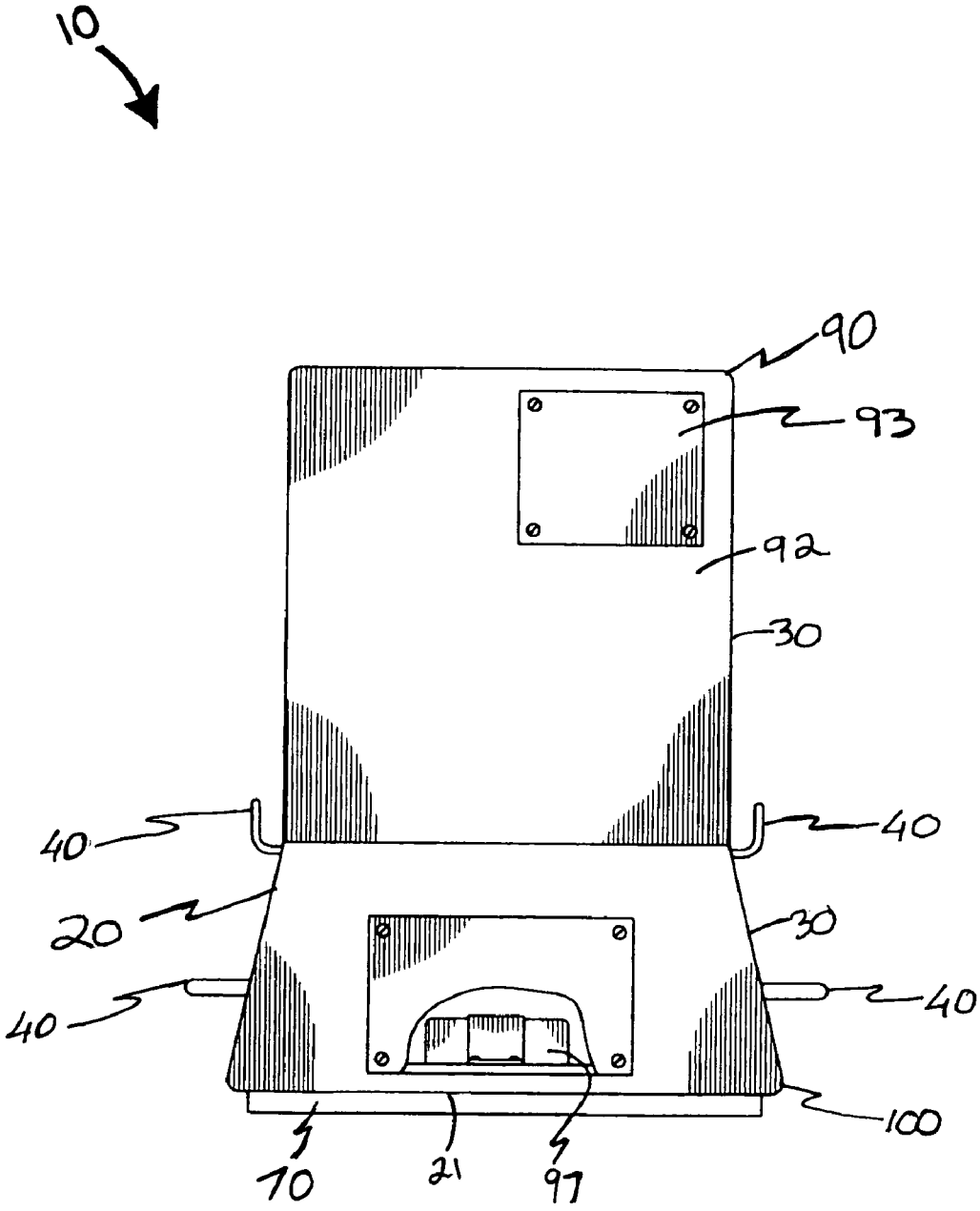
FIG. 4 is a rear elevational view of the system shown in FIG. 1, taken along line 4-4.
Figure 5:
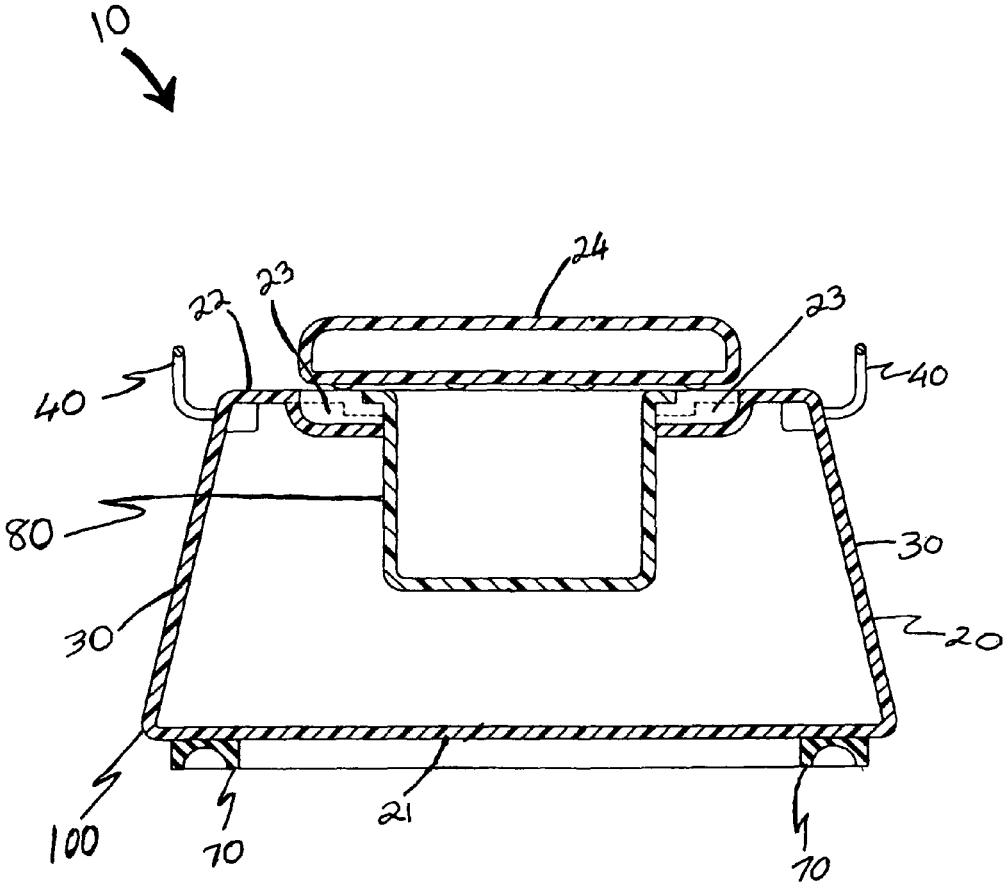
FIG. 5 is a cross-sectional view of the system shown in FIG. 1, taken along line 5-5.
Figure 6:
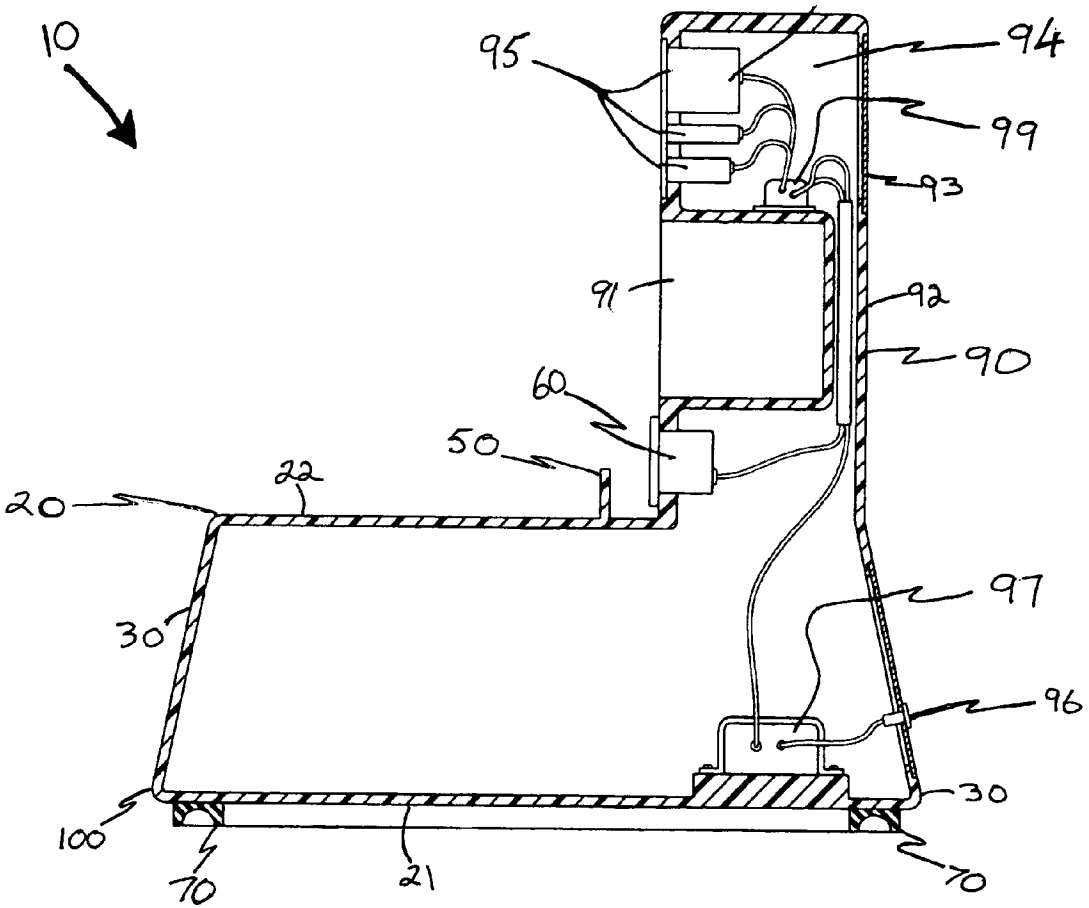
FIG. 6 is a cross-sectional view of the system shown in FIG. 1, taken along line 6-6 in FIG. 3.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The system of this invention is referred to generally in FIGS. 1-6 by the reference numeral 10 and is intended to provide a story telling potty training system. It should be under stood that the system 10 may be used to train children of many different ages, and should not be limited to any specific age group.

Referring initially to FIG. 1, the system 10 includes a base member 20 including a lower section 100 that has a plurality of sidewalls 30 integral with each other for forming a generally rectangular shape. The base member 20 may include a plurality of handles 40 connected thereto and extending outwardly from select ones of the plurality of sidewalls 30. Such a plurality of handles 40 assist a user to transport the system 10 between remote locations.

The system 10 further includes a splash guard 50 that has a substantially rectangular shape and is connected to the base member 20 adjacent to the plurality of speakers 60 so that the speakers 60 can be protected during operation of the system 10. The system may further include a seat 24 pivotally connected to the base member 20, which is selectively movable between open and closed positions for covering the opening 23.

The base member 20 has a substantially planer bottom surface 21 including a bottom layer 70 secured to the bottom surface 21 and is positionable on a ground surface. Such a bottom layer 70 may be formed from rubber material to thereby advantageously maintain the system 10 at a substantially stationary position during operating conditions. The base member 10 may further include a top surface 22 that has an opening 23 disposed substantially medially between the plurality of sidewalls 30.

A lower section XX of the base member 20 includes a reservoir 80 removably positionable within the opening 23 for receiving human excrements therein. An upper section 90 is connected to the lower section 100 and extends upwardly therefrom. The upper section 90 has a plurality of slots 91 formed therein for storing various objects. The upper section 90 further includes a rear surface 92 and an access panel 93 connected thereto. Such an access panel 93 allows an operator to selectively access an interior portion 94 of the upper section 90.

Advantageously, the system 10 further includes a mechanism 95 for playing an audio medium. Such a mechanism is preferably housed within the upper section 90 and disposed rearward of the opening 23. A power source 96 is connected to the playing mechanism 95 for supplying power thereto. Of course, such a power source 96 may include a rechargeable battery 97 so that the system 10 can be operated at remote locations.

The playing mechanism 95 may further include at least one electronic device 98 for providing audio sounds, a microprocessor 99 connected to at least one electronic device 98 for controlling the operation thereof based upon an input provided by a user, and a plurality of speakers 60. Such speakers are connected to the microprocessor 99 and are disposed partially exterior of the upper section 90 for channeling sounds towards the seat 24.

The system 10 may be used by parents to help teach young children how to use the toilet in a positive, gentle, fun, and non-stressful manner. It would allow the children to begin training on a child-size potty chair that would be comfortable, stable, and supportive, as well as enjoyable for the youngsters. With the system 10 the experience would be fun and interesting, instead of boring or scary. Because the playing mechanism 95 can accommodate a variety of stories, lessons, and rhymes, parents could choose the ones that are most interesting or beneficial for the individual child. Furthermore, developmental benefits of the system 10 include enhanced language and intellectual development, large and small motor skills, and the practical and necessary skills for daily potty use.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to on skilled in the art.

What is claimed as new and what is desired to secure by Letters Patent of the United States is:

1. A potty training system comprising:

a base member including a lower section having a plurality of sidewalls integral with each other for forming a generally rectangular shape, said base member further having a substantially planer bottom surface and a top surface having an opening disposed substantially medially between said plurality of sidewalls, said lower section including a reservoir removable positionable within said opening and for receiving human excrements therein, an upper section connected to said lower section and extending upwardly therefrom, said upper section having a plurality of slots formed therein for storing various objects, said base member includes a plurality of handles connected thereto and extending outwardly from select ones of said plurality of sidewalls, said plurality of handles assisting a user to transport said system between remote locations;

a seat pivotally connected to said base member and is selectively movable between open and closed positions for covering said opening;

means for playing an audio medium, said playing means is housed within said upper section and is disposed rearward of said opening, said playing means comprising at least one electronic device for providing audio sounds, a microprocessor connected to said at least one electronic device and for controlling the operation thereof based upon an input provided by a user, and a plurality of speakers connected to said microprocessor and is disposed partially exterior of said upper section; and a power source connected to said playing means and for supplying power thereto;

wherein said upper section is fixedly and statically coupled to said lower section;

wherein said reservoir is supported by said top surface of said lower section and thereby remains suspended above said bottom surface of said lower section;

wherein said reservoir remains statically mated with said top surface of said lower section while said seat is pivotally reciprocate between the open and closed positions;

wherein said reservoir has a fixed and rigid shape;

a splash guard having a substantially rectangular shape and is connected to said base member adjacent said plurality of speakers so that same can be protected during operation of said system.

2. The potty training system of claim 1, wherein said upper section further comprises:

a rear surface and an access panel connected thereto, said access panel allowing an operator to selectively access an interior portion of said upper section.

3. The potty training system of claim 1, wherein said power source comprises:

a rechargeable battery.

4. The potty training system of claim 1, further comprising:

a bottom layer secured to said bottom surface and is positionable on a ground surface, said bottom layer is formed from rubber material to thereby maintain said system at a substantially stationary position during operating conditions.

* * * * *